US007336253B2

(12) United States Patent
Kim

(10) Patent No.: US 7,336,253 B2
(45) Date of Patent: Feb. 26, 2008

(54) LIQUID CRYSTAL DISPLAY DEVICE AND METHOD FOR DRIVING THE SAME

(75) Inventor: Jong Dae Kim, Kyungsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/029,198

(22) Filed: Dec. 28, 2001

(65) Prior Publication Data

US 2002/0084972 A1 Jul. 4, 2002

(30) Foreign Application Priority Data

Dec. 28, 2000 (KR) ..... 10-2000-0084094

(51) Int. Cl.
*G09G 3/36* (2006.01)

(52) U.S. Cl. ..... 345/98; 345/87

(58) Field of Classification Search ..... 345/87–106, 345/204–215

See application file for complete search history.

(56) References Cited

U.S. PATENT DOCUMENTS 5,252,957 A * 10/1993 Itakura ..... 345/98
6,040,816 A * 3/2000 Uchino ..... 345/99
6,529,181 B2 * 3/2003 Nakano et al. ..... 345/98
6,535,192 B1 * 3/2003 Sung et al. ..... 345/94

FOREIGN PATENT DOCUMENTS

KR 10-1999-006775 A 1/1999
KR 10-2000-0074515 A 12/2000
KR 10-0358644 B1 10/2002
KR 10-0393669 B1 10/2003

* cited by examiner

*Primary Examiner*—Sumati Lefkowitz
*Assistant Examiner*—Srilakshmi K Kumar
(74) *Attorney, Agent, or Firm*—Birch, Stewart, Kolasch & Birch, LLP

(57) ABSTRACT

An LCD device and a method for driving the device reduces power consumption by transmitting data by using at least two clock signals having different phases. The LCD device displays a picture image by driving an LCD panel that includes multiple source drivers applying data signals to the LCD panel. Multiple gate drivers apply gate driving signals to the LCD panel, a timing controller outputs at least two clock signals having different phases and separately outputs data synchronized with each output signal, and at least two data buses transmit the data separately output from the timing controller to the source drivers. The method for driving the LCD device includes outputting at least two clock signals having different phases, and separately outputting the digital data synchronized with respective clock signals per odd/even numbered data or R/G/B display data through different data buses.

17 Claims, 5 Drawing Sheets

LIQUID CRYSTAL DISPLAY DEVICE AND METHOD FOR DRIVING THE SAME

BACKGROUND OF THE INVENTION

1. Field of the Invention

The present invention relates to a display device, and more particularly, to a liquid crystal display (LCD) device and a method for driving the same.

2. Background of the Related Art

In general, electromagnetic interference (EMI) means that electromagnetic waves directly or indirectly emitted from electronic appliances generate problems in an electromagnetic receiving function of other electronic appliances.

With an increasing number of various electronic appliances and the development of digital and semiconductor technologies, the utilization of precision electronic appliances proliferates, thereby generating large quantities of electromagnetic waves. Such electromagnetic waves cause EMI, operational failures of electronic appliances, and biological hazards.

The EMI has been an issue in LCD components of display devices. Particularly, it becomes increasingly necessary to reduce the EMI in LCD devices because the EMI degrades the display quality that is one of the most important elements in the display.

In general, an LCD includes two glass substrates, and a liquid crystal layer between the two glass substrates. In a thin film transistor (TFT) LCD, the TFT serves as a switching device that applies a signal voltage to the liquid crystal layer. The TFT LCD has attracted attention as a display device to substitute for a cathode ray tube (CRT) due to the LCD's low power consumption and portability.

As shown in FIG. 1, the TFT-LCD includes a lower substrate 1 having the TFT serving as the switching device, and an upper substrate 2 has a color filter. A liquid crystal is injected between the lower and upper substrates 1 and 2. The TFT-LCD can display a picture image by manipulating the electro-optical characteristics of the liquid crystal.

As also shown in FIG. 1, a TFT array region 4 is formed on the lower glass substrate 1. Then, a black matrix film 5, the color filter 6, a common electrode 7, and an alignment film 8 are formed on the upper glass substrate 2.

The lower and upper glass substrates 1 and 2 are attached to each other by a sealant such as an epoxy resin. A driving circuit 11 on a printed circuit board (PCB) 10 is connected to the lower glass substrate 1 through a tape carrier package (TCP) 12.

In a timing controller of the above described LCD device, a data signal is synchronized with a data clock signal DCLK, and then is provided to a source driver.

A related art LCD device will be described with reference to the accompanying drawings.

FIG. 2 is a structure view of a related art LCD device.

As shown in FIG. 2, the related art LCD device includes an LCD panel 21, source drivers 23, gate drivers 25, and a timing controller 27.

The source drivers 23 apply data signals to the LCD panel 21, and the gate drivers 25 apply gate driving signals to the LCD panel 21. The timing controller 27 outputs power supply and control signals for controlling the source and gate drivers, makes clock signals CLK by receiving a data clock signal DCLK and digital data from a system (not shown), and outputs data synchronized with the clock signals CLK to the source drivers 23.

At this time, the timing controller 27 provides the digital data input from the system to each source driver 23 through data buses DB. The timing controller 27 simultaneously provides the clock signals CLK to each source driver 23.

The LCD panel 21 displays a picture image by controlling the source and gate drivers 23 and 25. The LCD panel 21 includes a plurality of gate and data lines that cross, and the TFT and a pixel electrode are formed at the crossing point of the data and gate lines.

The TFT includes a gate electrode formed on the lower glass substrate, a gate insulating film formed on an entire surface of the lower glass substrate including the gate electrode, a semiconductor film formed on the gate insulating film above the gate electrode, and source and drain electrodes formed on the semiconductor film (not shown).

Then, a passivation film is formed on the entire surface of the lower glass substrate including the drain electrode, and the pixel electrode is electrically connected to the drain electrode through a contact hole formed on the passivation film (not shown).

In general, the number of the source and gate drivers formed varies according to resolution. In a LCD panel of XGA (Extended graphics array) degree, eight source drivers 23 and three gate drivers 25 are required.

The source drivers 23 apply R/G/B (red/green/blue) data synchronized with the clock signals CLK applied from the timing controller 27 to each data line of the LCD panel 21.

The timing controller 27 outputs various control signals required to drive the source and gate drivers 23 and 25, and then provides data transmitted from the system (not shown) to the source drivers 23 at a rising edge timing of the clock signals CLK.

As shown in FIG. 3, the timing controller 27 provides R/G/B digital data to the source drivers 23 at the rising edge timing, and the source driver 23 samples the data at a falling edge timing of the clock signal CLK.

If the data is sampled within the source drivers 23 at the rising edge timing, the timing controller 27 provides the data to the source drivers 23 at the falling edge timing of the clock signal CLK.

Then, in the source driver 23, the digital data is converted to analog data, is constantly amplified, and then is applied to each gate line, thereby displaying the picture image by driving signals of the gate drivers.

However, the related art LCD device has the following problems.

First, the source driver connected with the data bus samples data per the falling edge timing of the data clock. At this time, unnecessary voltage is used, thereby increasing power consumption.

Furthermore, if the data is transmitted by an equal clock signal, an EMI noise emitted relatively increases, thereby degrading display quality.

SUMMARY OF THE INVENTION

Accordingly, the present invention is directed to an LCD device and a method for driving the same that substantially solves one or more problems due to limitations and disadvantages of the related art.

An object of the present invention, in part, is to provide an LCD device and a method for driving the same that can reduce power consumption during transmitting data from a timing controller to each source driver by using at least two data clock signals having different phases.

The invention, in part, pertains a LCD panel of a LCD device that displays a picture image by using a plurality of source drivers applying data signals to the LCD panel, a plurality of gate drivers applying gate driving signals to the LCD panel, a timing controller outputting at least two clock signals having different phases and separately outputting data synchronized with each output signal, and at least two data buses transmitting the data separately output from the timing controller to the source drivers.

The invention, in part, pertains to a number of the data buses being in proportion to a number of clock signals output from the timing controller. The timing controller outputs data synchronized with a rising edge time of each clock signal, or the timing controller outputs data synchronized with a falling edge time of each clock signal. The timing controller outputs first and second clock signals having opposite phases to each other. The timing controller can also output first, second and third clock signals, each having different phases to each another.

The invention, in part, pertains to the source driver sampling data in the falling edge time when the data synchronized with the rising edge time is output. Alternatively, the source driver samples data in the rising edge time when the data synchronized in the falling edge timing is output. Odd numbered display data synchronizes with the rising edge of the first clock signal is output, and even numbered display data synchronizes with the rising edge of the second clock signal is output. Data for displaying R color synchronizes with the rising edge of the first clock signal, data for displaying G color synchronizes with the rising edge of the second clock signal, and data for displaying B color synchronizes with the third clock.

The invention, in part, pertains to a method for driving an LCD device having a timing controller transmitting digital data received from a system to each source driver. The method includes the steps of outputting at least two clock signals having different phases, and separately outputting the digital data synchronized with respective clock signals per odd/even numbered data or R/G/B digital data through different data buses.

In the LCD device according to the present invention and the method for driving the same, the timing controller outputs at least two clock signals to source drivers, and then data synchronized with each clock signal is output to the source drivers through data buses. Accordingly, data is separately output from the timing controller to the source drivers, so that power consumption used in the timing controller and each source driver can be reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

DETAILED DESCRIPTION OF THE INVENTION

Advantages of the present invention will become more apparent from the detailed description given herein after. However, it should be understood that the detailed description and specific examples, while indicating preferred embodiments of the invention, are given by way of illustration only, since various changes and modifications within the spirit and scope of the invention will become apparent to those skilled in the art from this detailed description.

Reference will now be made in detail to the preferred embodiments of the present invention, examples of which are illustrated in the accompanying drawings.

Figure 1:
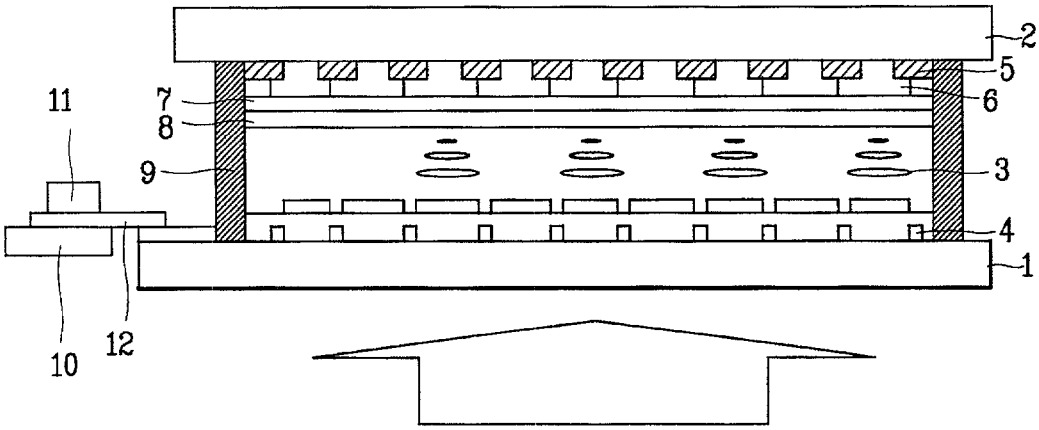
FIG. 1 is a sectional view of a general LCD panel.
Figure 2:
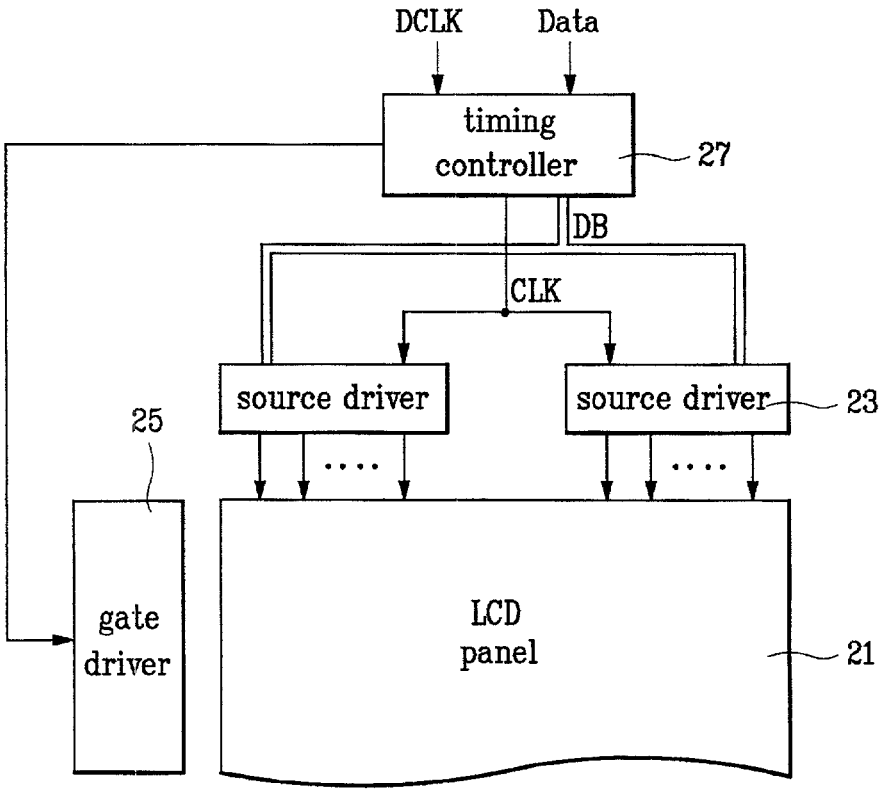
FIG. 2 is a schematic view showing a structure of a related art LCD device.
Figure 3:
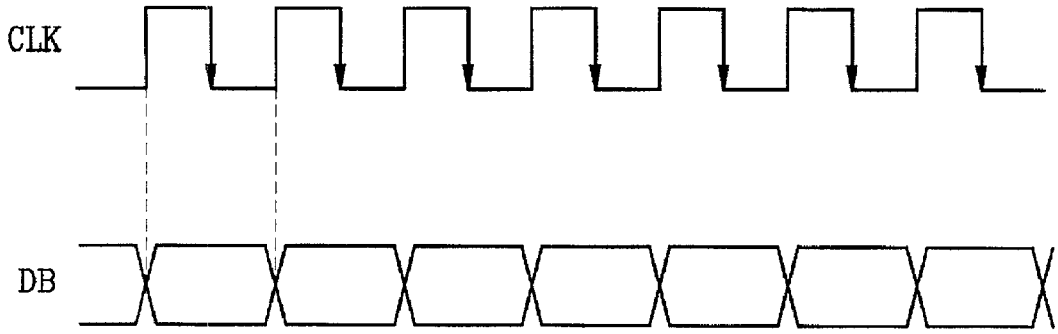
FIG. 3 is an operation timing view of a related art LCD device.
Figure 4:
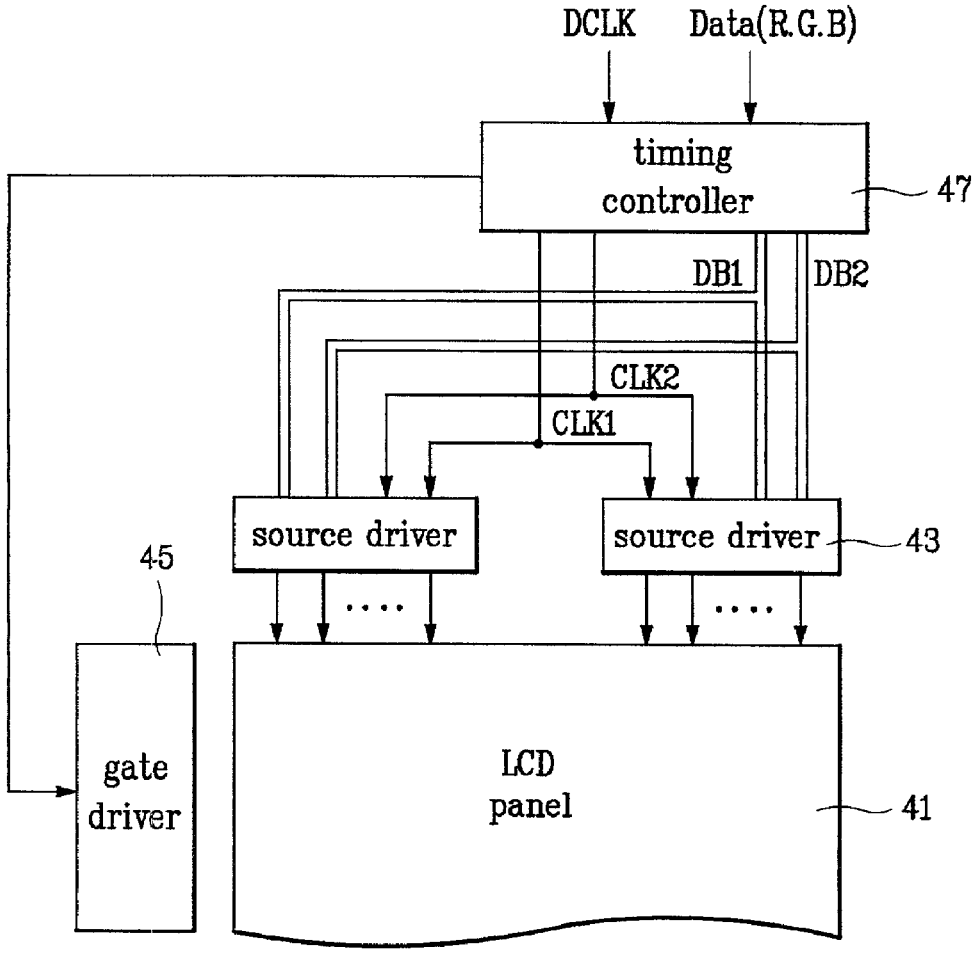
FIG. 4 is a schematic view of an LCD device according to the present invention.
Figure 5:
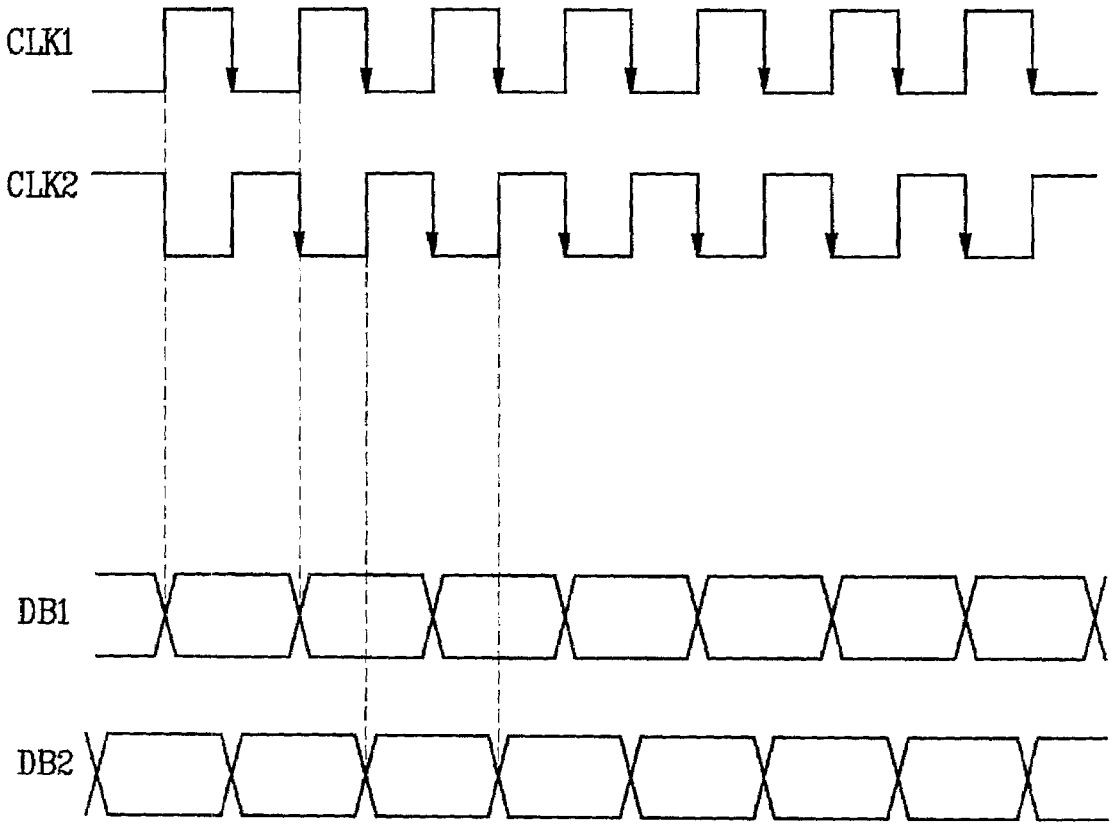
FIG. 5 is an operation timing view of an LCD device according to an embodiment of the present invention.

FIG. 4 shows a block diagram of an LCD device according to an embodiment of the present invention. FIG. 5 shows an operation timing view of the LCD device according to an embodiment of the present invention showing a method for driving the LCD device of the present invention.

As shown in FIG. 4, the LCD device of the present invention includes a LCD panel 41, a plurality of source drivers 43, a plurality of gate drivers 45, and a timing controller 47.

The plurality of source drivers 43 apply data signals to the LCD panel 41, and the plurality of gate drivers 45 apply gate driving signals to the LCD panel 41. The timing controller 47 receives a data clock signal DCLK and R/G/B digital data from a system (not shown), and outputs first and second clock signals CLK1 and CLK2 having different phases and various control signals to control the source and gate drivers 43 and 45.

At this time, the timing controller 47 is connected with each source driver by a first data bus DB1 transmitting the digital data synchronized with the first clock signal CLK1 to each source driver 43. A second data bus DB2 transmits the digital data synchronized with the second clock signal CLK2 to each source driver 43.

The R/G/B digital data is transmitted to odd numbered pixels by the first data bus DB1, and to even numbered pixels by the second data bus DB2. The phases of first and second clock signals CLK1 and CLK2 are opposite to each other.

The timing controller 47 receives the digital data from the system, synchronizes the digital data with a rising edge timing of the first clock signal CLK1, and outputs the digital data to each source driver 43 through the first data bus DB1. Also, the digital data is synchronized with the rising edge timing of the second clock signal CLK2, and is output to each source driver 43 through the second data bus DB2.

If the timing controller 47 outputs data synchronized with the rising edge timing, each source driver 43 samples the data synchronized with a falling edge timing applied from the timing controller 47. If the source driver 43 samples data synchronized with the rising edge timing, the timing controller 47 outputs data synchronized with the falling edge timing of the first and second clock signals CLK1 and CLK2 through the first and second data buses DB1 and DB2.

As shown in FIG. 5, the R/G/B digital data, synchronized with the rising edge timing of the first clock signal CLK1 and applied to the odd numbered pixels, is transmitted to the source driver 43 through the first data bus DB1. Also, the R/G/B digital data, synchronized with the rising edge timing of the second clock signal CLK2 having an opposite phase to the first clock signal CLK1 and applied to the even numbered pixels, is transmitted to the source driver 43 through the second data bus DB2.

The timing controller 47 synchronizes digital data received from the system with two clock signals through two data buses, and then separately outputs the synchronized digital data to the source drivers. As a result, electricity used in outputting data can be reduced.

The timing controller 47 separately outputs the digital data, so that the source driver 43 separately samples the digital data. Therefore, electricity used in sampling the digital data in the source driver 43 can be reduced, thereby substantially reducing electricity for driving the whole circuit as compared to the related art.

Figure 6:
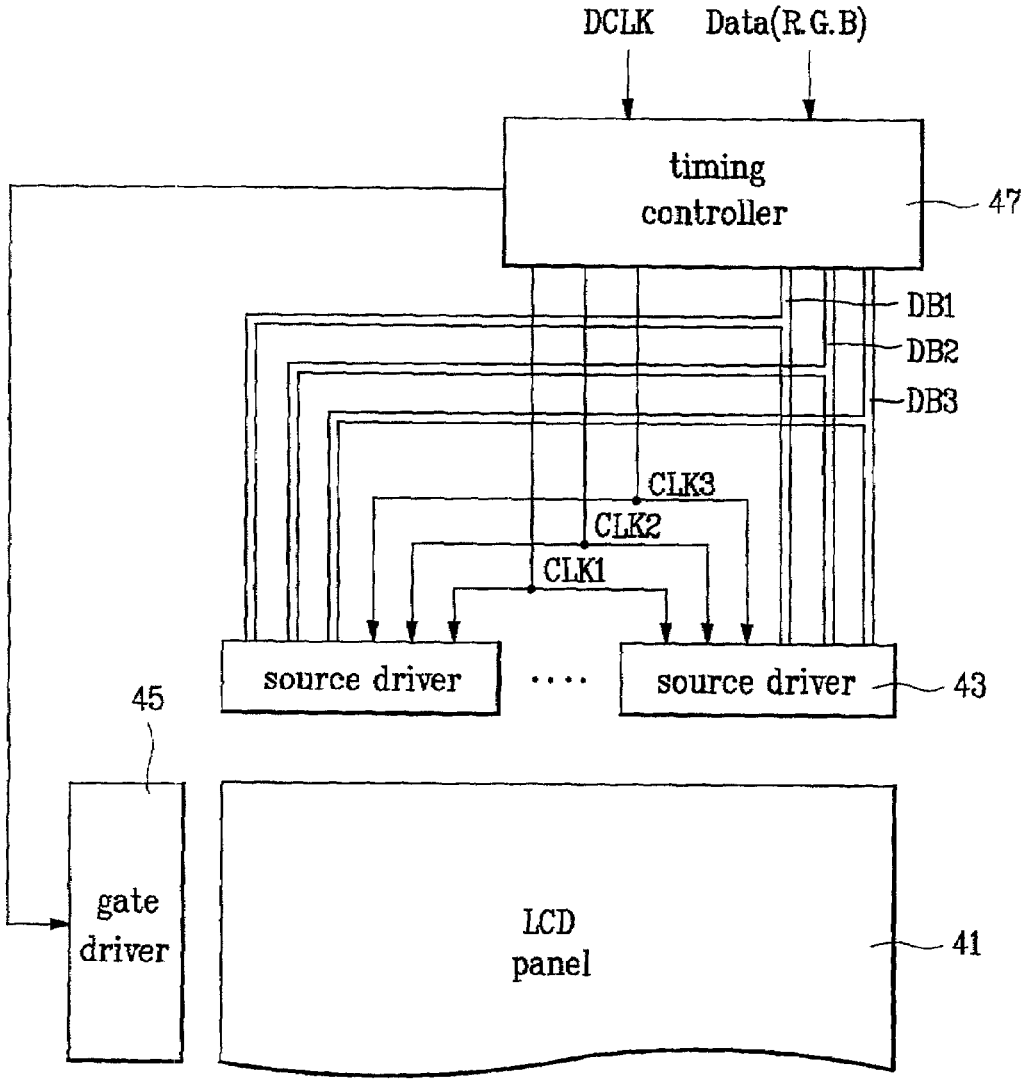
FIG. 6 is a schematic view of an LCD device according to another embodiment of the present invention.
Figure 7:
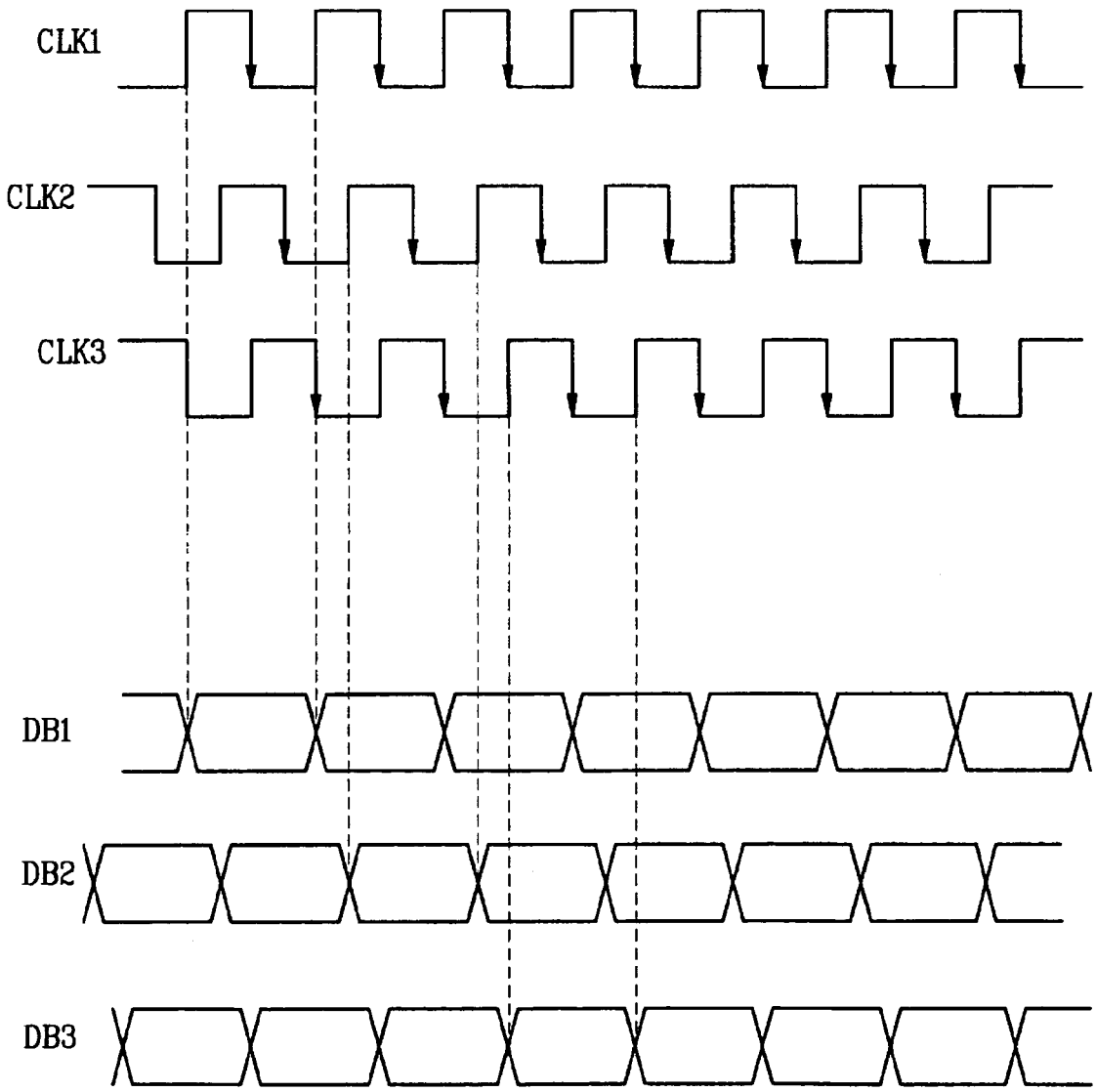
FIG. 7 is an operation timing view of an LCD device according to another embodiment of the present invention.

FIG. 6 is a block diagram of a LCD device according to another embodiment of the present invention. FIG. 7 is an operation timing view of the LCD device according to another embodiment of the present invention.

In another embodiment of the present invention, three clock signals CLK1, CLK2 and CLK3 having different phases are generated. Then, a timing controller separately outputs R/G/B digital data synchronized with the each clock signal to source drivers through the first, second and third data buses DB1, DB2 and DB3.

As shown in FIG. 6, the LCD device according to another embodiment of the present invention includes an LCD panel, a plurality of source drivers 43, a plurality of gate drivers 45, and a timing controller 47.

The plurality of source drivers 43 apply data signals to the LCD panel 41, and the plurality of gate drivers 45 apply gate driving signals to the LCD panel 41. The timing controller 47 receives data clock signal DCLK and R/G/B digital data from a system (not shown), and outputs various control signals for controlling the source and gate drivers 43 and 45 and first, second, and third clock signals CLK1, CLK2 and CLK3 having different phases.

At this time, the timing controller 47 is connected with each source driver 43 by the first, second and third data buses DB1, DB2 and DB3. The data for displaying R color synchronized with the first clock signal CLK1 is transmitted to each source driver 43 by the first data bus DB1. The data for displaying G color synchronized with the second clock signal CLK2 is transmitted to each source driver 43 by the second data bus DB2. The data for displaying B color synchronized with the third clock signal CLK3 is transmitted to each source driver 43 by the third data bus DB3.

The R/G/B digital data transmits to the timing controller 47 from the system. Then, the R/G/B digital data is synchronized with a rising edge of the first clock signal CLK1, and then the digital data for displaying R color outputs to each source driver through the first data bus DB1. The R/G/B digital data is synchronized with the rising edge of the second clock signal CLK2, and then the digital data for displaying G color outputs to each source driver through the second data bus DB2. The R/G/B digital data is synchronized with the rising edge of the third clock signal CLK3, and then the digital data for displaying B color outputs to each source driver through the third data bus DB3.

At this time, if the timing controller 47 outputs data synchronized with the rising edge, each source driver 43 samples the data synchronized with the falling edge time and applied from the timing controller 47. If the source driver 43 samples data synchronized with the rising edge, the timing controller 47 outputs the data synchronized with the falling edge time of the first, second and third clock signals CLK1, CLK2 and CLK3 through the first, second and third data buses DB1, DB2 and DB3.

As shown in FIG. 7, in a driving circuit of the LCD device according to another embodiment of the present invention, the data for driving R color synchronized with the rising edge of the first clock signal CLK1 transmits to each source driver 43 through the first data bus DB1, and the data for driving G color synchronized with the rising edge of the second clock signal CLK2 having a different phase to the first clock signal CLK1 transmits to the source driver through the second data bus DB2. The data for driving B color synchronized with the rising edge of the third clock signal CLK3 having a different phase to the first and second clock signals CLK2 and CLK3 is transmits to the source driver through the third data bus DB3.

That is, the timing controller 47 separately outputs digital data received from the system and synchronized with the three clock signals per the R/G/B digital data through the three data buses to each source driver, thereby reducing the electric power used in outputting the data.

Also, the timing controller 47 separately outputs digital data according to the R/G/B digital data, so that the source driver 43 separately samples the digital data according to the R/G/B digital data. Therefore, the electric power consumption for driving the whole circuit can be reduced.

As discussed above, the LCD device according to the present invention has the following advantages.

First, the timing controller separately outputs the digital data received from the system synchronized with each clock signal to the source driver through at least two data buses, thereby reducing the electric power used in outputting the data from the timing controller to the source driver and in sampling the data in the source driver. Therefore, electricity requirement for driving the whole circuit can be reduced.

Furthermore, data is separately transmitted per odd/even numbered data or R/G/B digital data by using at least two clock signals having different phases, so that electromagnetic interference can be reduced. Therefore, it is possible to prevent degradation of the picture quality.

The forgoing embodiments are merely exemplary and are not to be construed as limiting the present invention. The present teachings can be readily applied to other types of apparatuses and methods. The description of the present invention is intended to be illustrative, and not to limit the scope of the claims. Many alternatives, modifications, and variations will be apparent to those skilled in the art.

What is claimed is:

1. An LCD device, comprising:

a LCD panel;

a plurality of source drivers applying data signals to the LCD panel;

a timing controller outputting to each source driver at least two clock signals having different phases, the timing controller separately outputting R/G/B data synchronized with each clock signal to each source-driver; and at least two data buses transmitting the data separately output from the timing controller to the respective source drivers, respectively, wherein the at least two data buses are connected between the timing controller and the respective source drivers, a number of the data buses are in proportion to the number of click signals output from the timing controller, and the source drivers separately sample the data to thereby reduce electricity consumption.

2. The LCD device as claimed in claim 1, wherein the timing controller outputs the data synchronized with a rising edge time of each clock signal.

3. The LCD device as claimed in claim 1, wherein the timing controller outputs the data synchronized with a falling edge time of each clock signal.

4. The LCD device as claimed in claim 1, wherein the timing controller outputs first and second clock signals having opposite phases to each other.

5. The LCD device as claimed in claim 1, wherein the timing controller outputs first, second and third clock signals, each having different phases to each another.

6. The LCD device as claimed in claim 3, wherein the source driver samples data in the falling edge time when the data synchronized with the rising edge time is output.

7. The LCD device as claimed in claim 4, wherein the source driver samples data in the rising edge time when the data synchronized in the falling edge timing is output.

8. The LCD device as claimed in claim 4, wherein odd numbered display data is output synchronized with a rising edge of the first clock signal, and even numbered display data synchronized with a rising edge of the second clock signal is output.

9. The LCD device as claimed in claim 5, wherein data for displaying R color is output synchronized with a rising edge of the first clock signal, data for displaying G color is output synchronized with a rising edge of the second clock signal, and data for displaying B color is output synchronized with a rising edge of the third clock signal.

10. A method for driving an LCD device having a timing controller transmitting digital data received from a system to each source driver, comprising the steps of:

providing a timing controller and a plurality of source drivers;

outputting from the timing controller at least two clock signals having different phases to each source driver; and separately outputting from the timing controller the digital data to each source driver through both of at least two data buses, the digital data being synchronized with respective clock signals per odd/even numbered data or R/G/B display data, wherein the at least two data buses are connected between the timing controller and each source driver, respectively, a number of the data buses are in proportion to a number of clock signals output from the timing controller, and the source drivers separately sample the digital data to thereby reduce electricity consumption.

11. The method as claimed in claim 10, wherein the digital data is synchronized with a rising edge of each clock signal.

12. The method as claimed in claim 11, wherein each source driver samples the digital data synchronized with a falling edge of each clock signal if the digital data is output synchronized with the rising edge of each clock signal.

13. The method as claimed in claim 10, wherein the digital data is output synchronized with a falling edge of each clock signal.

14. The method as claimed in claim 13, wherein each source driver samples the digital data synchronized with a rising edge of each clock signal if the digital data is output synchronized with the falling edge of each clock signal.

15. The method as claimed in claim 10, wherein two clock signals having different phases are used when the digital data is separately output according to odd and even numbered data, and three clock signals having different phases are used when the data is separately output according to R/G/B data.

16. The LCD device as claimed in claim 1, wherein the at least two data buses are separated from each other.

17. The method as claimed in claim 10, wherein the at least two data buses are separated from each other.

* * * * *